United States Patent [19]

Adrian et al.

[11] Patent Number: 4,474,120

[45] Date of Patent: Oct. 2, 1984

[54] METHOD FOR AT LEAST THE TWO-STAGE IGNITION OF A FUEL DUST POWER BURNER AND A BURNER SYSTEM FOR CARRYING OUT THIS METHOD

[75] Inventors: Fritz Adrian, Ratingen; Theodor Grund, Kamen; Udo Strauss, Bochum, all of Fed. Rep. of Germany

[73] Assignee: Steag AG, Fed. Rep. of Germany

[21] Appl. No.: 352,072

[22] Filed: Feb. 25, 1982

[30] Foreign Application Priority Data

Feb. 27, 1981 [DE] Fed. Rep. of Germany ..... 3107649

[51] Int. Cl.[3] ..... F23C 1/10

[52] U.S. Cl. ..... 110/261; 110/347; 431/174; 431/178; 431/284

[58] Field of Search ..... 431/174, 178, 188, 278, 431/284, 285; 110/261, 263-265, 347

[56] References Cited

U.S. PATENT DOCUMENTS

| | | | |
|---|---|---|---|
| 3,822,654 | 7/1974 | Ghelfi | 431/284 |
| 4,095,929 | 6/1978 | McCartney | 431/188 |
| 4,150,631 | 4/1979 | Frey et al. | 110/265 |
| 4,206,712 | 6/1980 | Vatsky | 110/261 |
| 4,316,420 | 2/1982 | Kochey | 110/347 |
| 4,333,405 | 6/1982 | Michelfelder et al. | 110/347 |

FOREIGN PATENT DOCUMENTS

| | | | |
|---|---|---|---|
| 5438 | 11/1979 | European Pat. Off. . | |
| 1060082 | 6/1959 | Fed. Rep. of Germany | 431/188 |
| 965898 | 8/1964 | United Kingdom . | |

*Primary Examiner*—Carroll B. Dority, Jr.

*Attorney, Agent, or Firm*—Andrus, Sceales, Starke & Sawall

[57] ABSTRACT

In a method for the ignition of a fuel dust power burner, in which the ignition energy is provided by a fuel dust pilot burner, for example for the ignition of a coal dust burner with a coal dust igniting flame, the ignition performance of the igniting flame is not adequate in some cases. In order to increase the ignition performance, so as also to be able to ignite the flames of high-powered power burners, it is proposed that, after ignition of the igniting flame to which coal dust and air are supplied by respective tube, a mixture of additional igniting coal dust supplied by way of a further tube and air is conducted to this flame by way of the power fuel dust tube, and then the power fuel dust is supplied along the power fuel dust tube.

11 Claims, 6 Drawing Figures

METHOD FOR AT LEAST THE TWO-STAGE IGNITION OF A FUEL DUST POWER BURNER AND A BURNER SYSTEM FOR CARRYING OUT THIS METHOD

This invention relates to a method for the ignition of a fuel dust power burner, in which the ignition energy is provided by a fuel dust pilot burner, and more particularly but not exclusively for the ignition of a coal dust burner with a coal dust igniting flame.

A method for the one-stage ignition of an annular coal dust burner by means of a fuel dust igniting flame is known from German Auslegeschriften Nos. 29 33 040 and 29 33 060. In the known methods, after ignition of the fuel dust igniting flame the power coal dust is blown into the igniting flame through the fuel dust air tube of the annular burner, and in this way the power burner flame is ignited.

With such a single-stage ignition of a fuel dust power burner flame, there is a danger that the ignition performance of the igniting flame may not be adequate for igniting the flame of a very high-powered coal dust burner having a cross-section suitable for the supply of a mixture of igniting fuel dust and air and a cross-section surrounding this for the supply of surface air.

It is also possible that, where there is direct connection of the power burner or burner system to crushers for producing the power fuel dust, these cross-sections may not be adequate for preparing a sufficient amount of warm air for preheating the crusher.

It is therefore the object of the invention to increase the ignition performance of the igniting flame, in order to also be able to ignite the flames of high-powered power burners.

According to the present invention, after ignition of the pilot burner, a mixture of additional igniting fuel dust and air is passed to the pilot burner flame, and then the power fuel dust is introduced. As in the prior art, the igniting fuel dust differs from the power fuel dust in grain size and/or consistency; the same applies to the additional igniting fuel dust. It is thereby possible for the additional fuel dust to differ in grain size and/or consistency from the igniting fuel dust initially supplied. The additional igniting fuel dust can be, for example, of a coarser grain size than the igniting fuel dust initially supplied.

In the known arrangement of a pilot burner in a power burner, the additional igniting fuel dust is fed in an essentially coaxial distribution in relation to the igniting fuel dust. The coaxial distribution can be uniform or non-uniform in the peripheral direction.

When the power burners are arranged in a line and the pilot burner arranged between them, the additional igniting fuel dust can be supplied by way of the power dust tubes of the power burners or through additional supply cross-sections.

With a non-uniform peripheral distribution of the additional fuel dust in relation to the flame burning with the initially supplied igniting fuel dust, areas are defined around the igniting flame through which air/oxygen can easily enter into the igniting flame from the power burner surface air.

In carrying out the method according to the invention, which is thus at least a two-stage ignition process utilising ignition fuel dust, it is advantageous if, before igniting the power fuel dust, sufficient warm air is available for preheating the coal crushers by means of which the power fuel dust is milled.

The invention also provides a burner system for carrying out the above-described method. The invention proceeds from a burner system consisting of at least one fuel dust power burner and at least one fuel dust pilot burner. According to the invention, the burner system has a supply device for feeding additional igniting fuel dust into the pilot burner flame.

Should the primary igniting fuel dust and the additional fuel dust be of the same grain size and consistency, then it is possible to feed the additional igniting fuel dust through suitable feeder devices in the burner system through an igniting fuel dust pipeline.

In a burner system with the pilot burner in the power burner, a part of the cross-section of the power dust tube may be designed as a supply cross-section for the additional igniting fuel dust. In burner systems with the pilot and power burners arranged in a line, a part of the cross-section of the power dust tube of the power burner in the form of a jet burner may be designed as the supply cross-section for the additional igniting fuel dust, and/or additional igniting fuel dust nozzles are attached to the pilot burner. Finally in such burner systems it is also possible for a pilot burner formed separately opposite the power burners to itself be provided with a device for the additional fuel dust.

In order that the invention may be more fully understood, reference will now be made, by way of example, to the accompanying drawings, in which.

Figure 1:
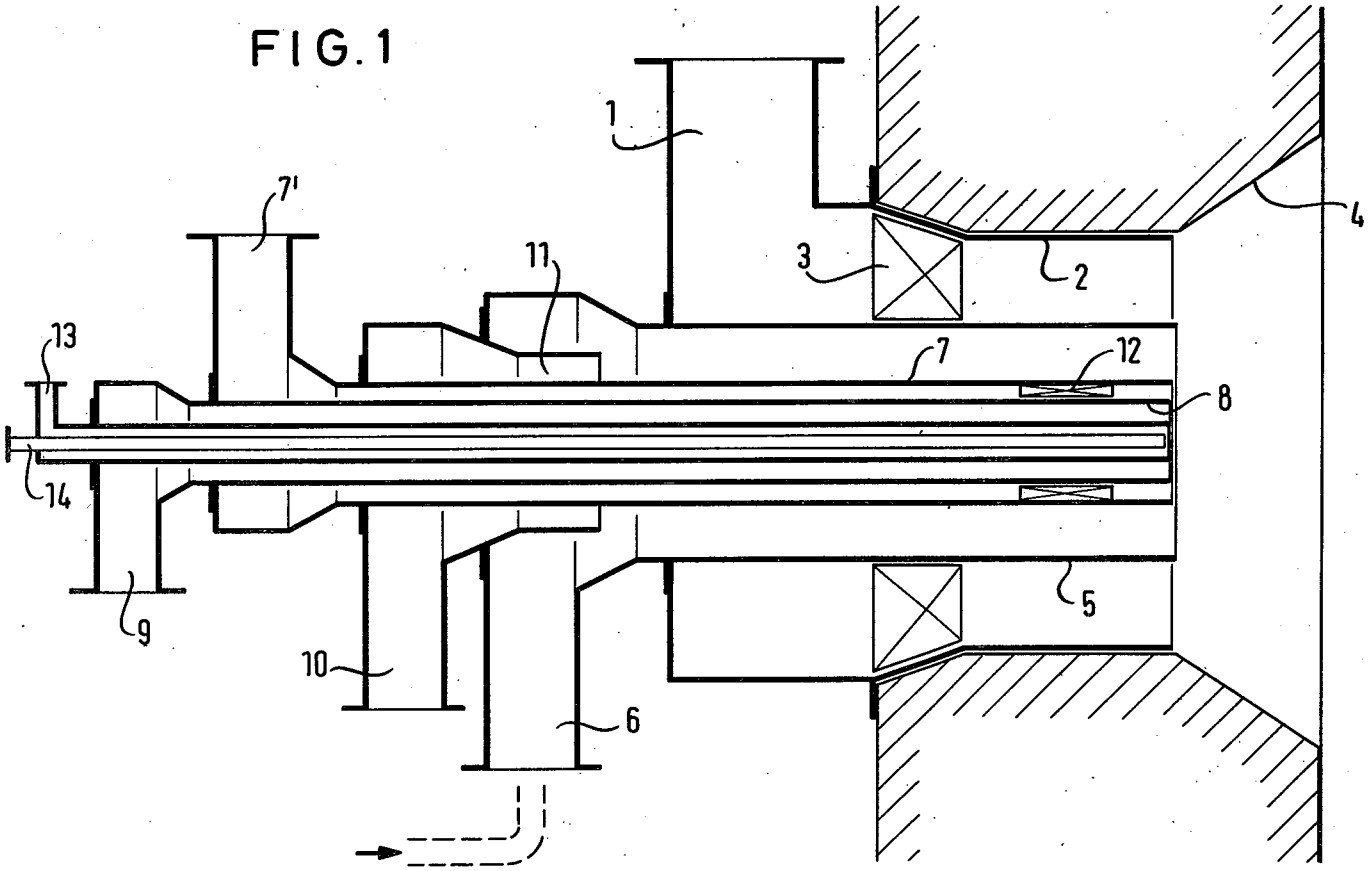
FIG. 1 is a diagrmmmatical longitudinal section through an annular pilot burner in an annular power burner system with two-stage ignition in accordance with the invention.

In FIG. 1 a burner system is shown having a two-stage pilot burner, preferably for vertical or almost vertical assembly. In a surface air inlet 1 of the power burner an angled vane ring 3 is provided in the part of a surface air tube 2 which narrows conically. The vanes of the ring 3 can be adjusted by a control mechanism which is not shown. A burner retort 4 is connected to the surface air tube 2 which is made of a ceramic material and is placed in a framework of tubes which is formed by the wall piping of the combustion chamber. A power coal dust tube 5 with a power coal dust inlet 6 extends coaxially with the surface air tube 2, and an ignition surface air tube 7 of the coal dust pilot burner, connected to an ignition air inlet 7', extends coaxially with the power coal dust tube 5 and surface air tube 2. In addition, an igniting coal dust tube 8 of the pilot burner which is connected to an igniting coal dust inlet 9 also extends coaxially with the tubes 2, 5 and 7.

The power coal dust inlet 6 and the ignition air inlet 7' are kept a certain distance apart axially, so that a supply device 10 for the additional igniting fuel dust can be arranged between them, this supply device leading into an additional igniting coal dust tube 11, which surrounds the ignition surface air tube 7, and extends into the power coal dust tube 5 via the power coal dust inlet 6. In the figure, the tubes are narrowed conically but not the inlets. As can be seen from the figure, the additional igniting coal dust tube 11 does not extend very far into the power coal dust tube 5. For this reason, the arrangement is particularly suitable for a vertical assembly, since the additional igniting coal dust emerging from the annular supply cross-section of the additional igniting coal dust tube 11 can fall into the combustion chamber under the influence of gravity.

Between the ignition surface air tube 7 and the igniting coal dust tube 8, that is in the igniting surface air cross-section, annular and, if necessary, adjustable angled vanes 12 are arranged just in front of the outlet. The ignition surface air emerges from the surface air tube 7 at high speed and with a strong axial rotation imposed on it, so that a funnel-shaped widening of the annular jet can result without a separate burner retort.

As the igniter, a gas igniter is arranged inside the igniting coal dust tube 8 and has an air inlet 13 and a gas inlet 14. Other known types of igniter can also be used.

After ignition of the igniter, first of all during operation of the burner system the igniting coal dust tube 8 is loaded with a mixture of igniting coal dust and air, and igniting air is fed through the ignition surface air tube 7. After an igniting flame has formed which is stabilised under the influence of the compressed air muffle, additional coal dust from the additional igniting coal dust tube 11 is fed through the inlet 10 into the power coal dust tube 5, and is conducted with the air flowing in the power coal dust tube to the peripheral area of the stable burning igniting flame, whereby its ignition performance is increased. The power coal dust tube 5 is then loaded with the power coal dust. Obviously the air supply in the surface air tube 2 of the power burner is controlled accordingly.

Figure 2:
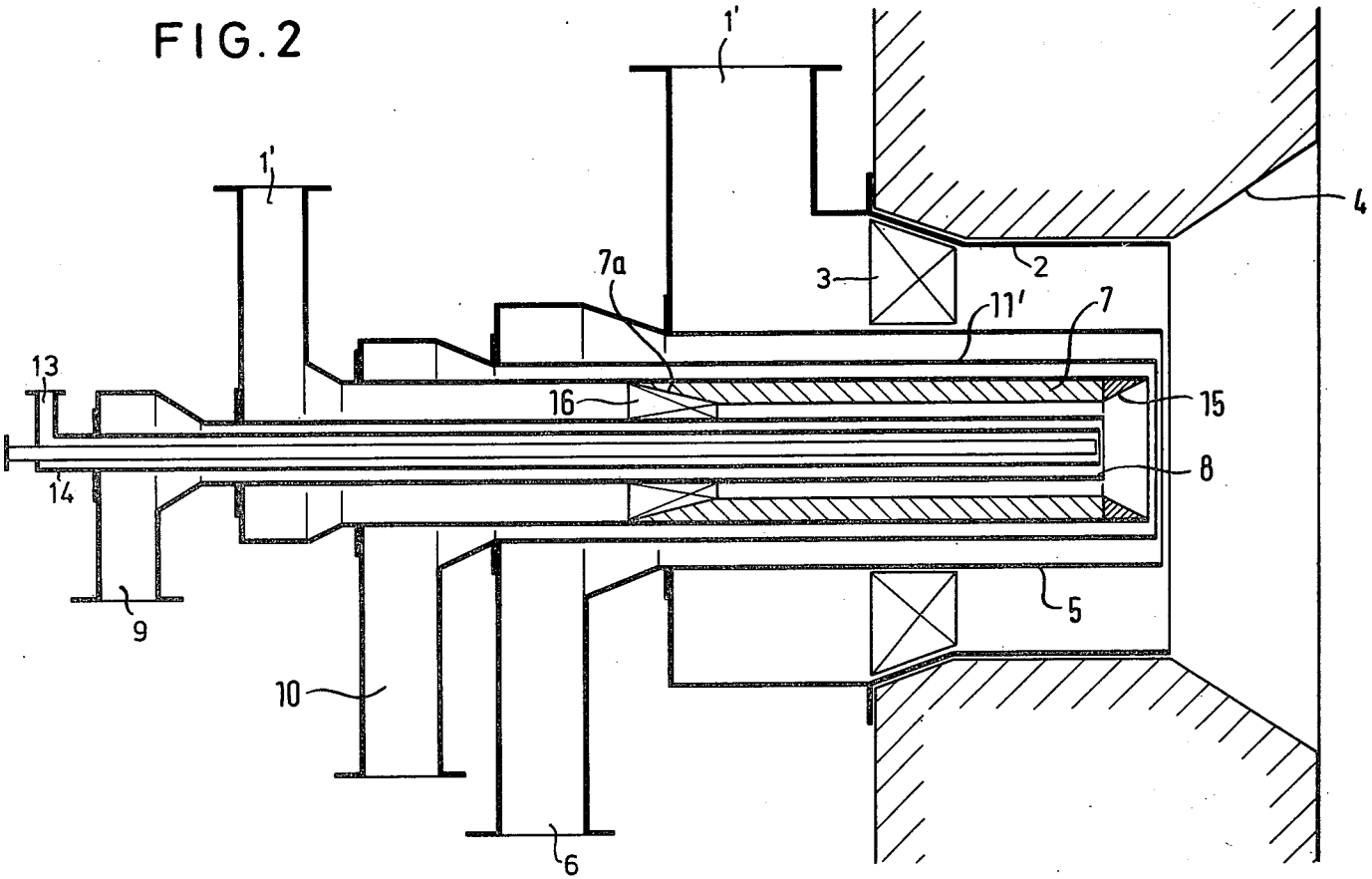
FIG. 2 shows another embodiment of an annular burner system in accordance with the invention.

The burner system shown in FIG. 2 also has a two-stage pilot burner, and is preferably suitable for horizontal assembly. In FIG. 2, components corresponding to those shown in FIG. 1 and described above have been given similar reference numerals. For purposes of horizontal assembly, the additional igniting coal dust tube 11' extends essentially over the whole length of the power coal dust tube 5, so that, even without loading the power coal dust tube 5 with sufficient delivery air through the conveying cross-section of the additional igniting coal dust tube 11', a relatively rich mixture of additional igniting coal dust and air can be fed into the surface area of the igniting flame.

The pilot burner differs from that in FIG. 1 in that the stabilising of the igniting flame, which burns with the igniting coal dust, is not achieved by means of a compressed air muffle but by a burner retort 15 which is arranged on the free end of the ignition surface air tube 7. The ignition surface air tube has a conically narrowing part *7a* at some distance from the burner retort 15 in which an adjustable angled vane ring 16 is arranged.

The stabilising arrangement according to FIG. 1 can be used in the two-stage pilot burner according to FIG. 2, and vice versa.

Figure 3:
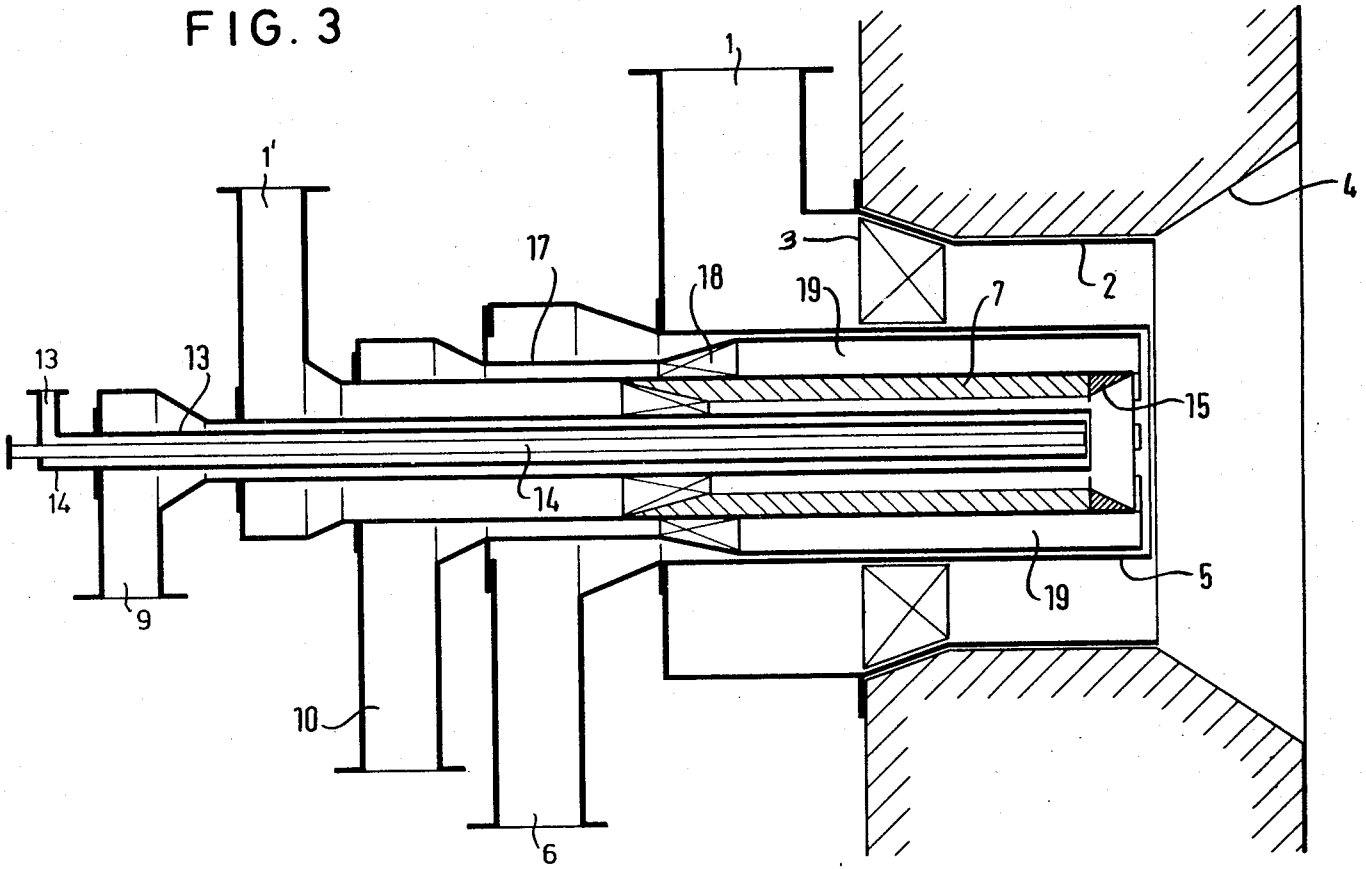
FIG. 3 shows a third embodiment in accordance with the invention.

In the burner system having a two-stage pilot burner shown in FIG. 3, the mixture of additional igniting coal dust and air fed through the additional igniting fuel dust inlet 10 is first of all passed into an additional igniting coal dust tube 17 from which the mixture is distributed by a distributor device 18 with a baffle plate to several single nozzles 19 leading to the flame area. Distribution can, however, also result outside the burner to individual cross-sections leading outwards.

Figure 4:
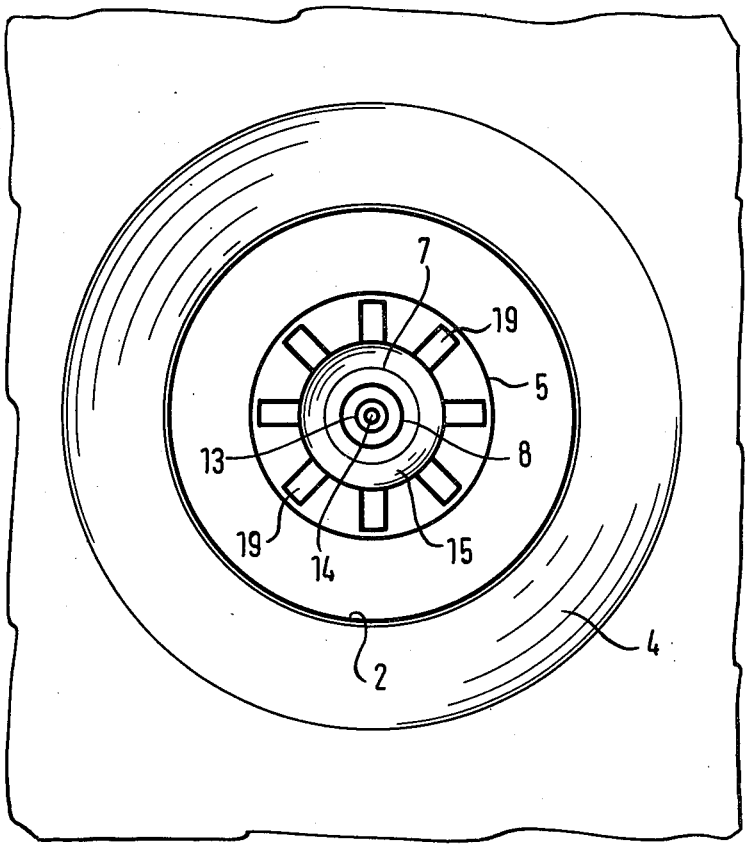
FIG. 4 is a front view of the burner according to FIG. 3.

FIG. 4 shows the uniform distribution of the individual nozzles 19 in the peripheral direction of the power coal dust tube 5. When in operation, single jets of additional igniting coal dust are blown from the individual nozzles 19 into the peripheral area of the igniting flame, so that in the peripheral direction of the igniting flame there remain preferred areas for drawing off air/oxygen from the surface air conducted through the surface air tube 2.

Of course the two-stage pilot burner according to FIG. 3 can also be operated with compressed air stabilisation according to FIG. 1. The individual nozzles 19 do not necessarily need to have the rectangular cross-section shown in FIG. 4; the use of tubes for the individual nozzles is also possible.

Figure 5:
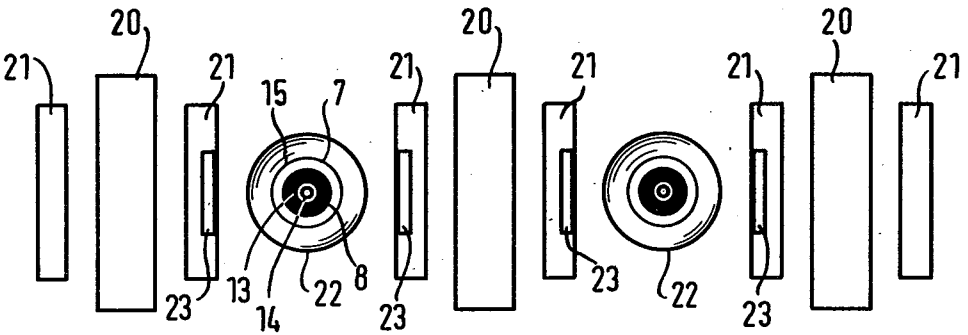
FIG. 5 shows a front view of surface burners.
Figure 6:
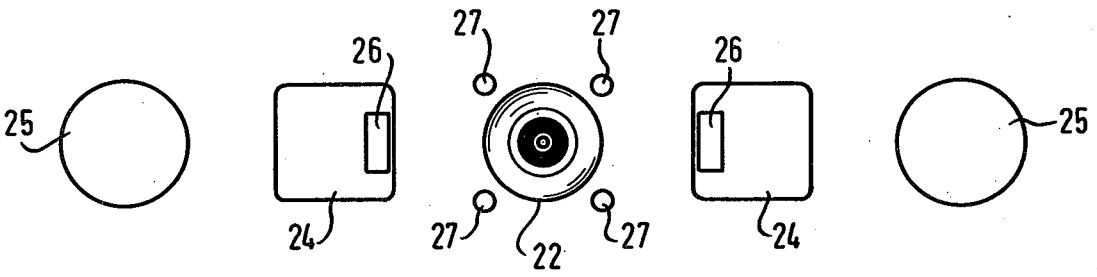
FIG. 6 shows a front view of corner burners.

FIGS. 5 and 6 show surface configuration for surface burners and corner burners, respectively.

In FIG. 5 power fuel dust nozzles 21 for power burners are arranged on both sides of the air nozzles 20. Between the power burners comprised of air nozzles 20 and fuel dust nozzles 21 annular pilot burners 22 are arranged which correspond in their structure approximately to the pilot burner according to FIG. 2. Therefore the reference numerals of FIG. 2 are used. The shaded cross-section corresponds to the supply cross-section of the igniting coal dust tube 8.

Additional igniting fuel dust nozzles 23 are provided in the power fuel dust nozzles 21 adjacent to the pilot burner 22. Since FIG. 5 relates to surface burners, it is not necessary for the additional igniting fuel dust nozzles 23 to extend up tb the free end of the power fuel dust nozzles 21, that is the additional igniting fuel dust nozzles 23 can end in a similar way to the additional igniting coal dust tube 11 in the embodiment according to FIG. 1, that is set back.

FIG. 6 shows a corner burner system with a central pilot burner 22, power fuel dust nozzles 24 and power air nozzles 25. Here also, additional igniting fuel dust nozzles 26 are arranged in the power fuel dust nozzles 24.

Under certain circumstances it is possible for the additional igniting fuel dust not to be fed through the power fuel dust nozzles 24, or not only through these nozzles, in that additional igniting fuel dust nozzles 27 are distributed around the pilot burner.

Since the corner burner system comprises a horizontal arrangement of the power fuel dust nozzles 24, it is appropriate for the additional igniting fuel dust nozzles 26 to extend up to the free end of the power fuel dust nozzles 24, as is the case in the burner-in-burner arrangement according to FIG. 2.

In FIGS. 5 and 6, the combustion chamber wall shown in FIGS. 1 to 3 is not illustrated.

With the surface burners and corner burners according to FIGS. 5 and 6, pilot burners 22 can also be used which are designed for two-stage ignition. Thus, for example, the two-stage pilot burner according to FIG. 2, that is the enclosed arrangement including the additional igniting fuel dust tube 11, can be used instead of the pilot burner 22 in FIGS. 5 and 6. It is also possible to use the two-stage pilot burner arrangement according to FIG. 3, if necessary encasing the individual nozzles 19 in a jacket, as separate pilot burners in the burner systems according to FIGS. 5 or 6.

Finally, it should be pointed out that, in FIGS. 2 and 3, the free space remaining in the area of the narrowing part *7a* and the narrower section of the ignition surface air tube 7 can be filled up or, as shown by the shaded section, padded out. The inner cross-section for the additional igniting coal dust can then be limited by a straight cylindrical tube section. Of course, in carrying out the method according to the invention and in constructing the burner systems according to the invention, it is only a question of the corresponding cross-sections being available for the air supply and fuel dust supply.

Depending on the geometry and on the fuel, it would also be possible, in the arrangement according to FIG. 1, to omit an additional igniting fuel dust supply 10 and a special additional igniting coal dust tube 11, and to blow the additional igniting coal dust by a suitable method into the power coal dust inlet 6 or into a pipeline connected to this inlet.

We claim:

1. A method for igniting an annular power burner burning pulverized power fuel with a centrally located pilot burner, said method comprising the steps of:

igniting a pilot burner with pulverized pilot fuel to provide a pilot flame;

supplying a mixture of additional pulverized fuel and air to the pilot flame peripherally about the centrally located pilot burner; and thereafter igniting the pulverized power fuel of the power burner from the pilot flame to burn the power fuel.

2. A method according to claim 1 wherein the pulverized pilot fuel has properties of grain size and consistency and wherein the method is further defined as supplying additional pulverized fuel to the pilot flame corresponding to the pulverized pilot fuel in at least one of grain size and consistency.

3. A method according to claim 1 wherein the method is further defined as supplying the additional pulverized fuel to the pilot flame in an essentially uniform peripheral distribution about the pilot burner.

4. A method according to claim 1 wherein the method is further defined as supplying the additional pulverized fuel to the pilot flame at spaced locations about the periphery of the pilot burner.

5. A burner system comprising:

a pilot burner burning pulverized pilot fuel to produce a pilot flame;

an annular power burner ignited by said pilot burner and burning pulverized power fuel, said pilot burner being centrally located with respect to said annular power burner; and means for supplying additional pulverized fuel to the pilot blame for improving ignition performance of said pilot burner in igniting said power burner, said power burner having an annular power fuel supply conduit surrounded by a surface air tube, said pilot burner having a pilot fuel supply conduit and surrounding air tube lying within said power supply fuel conduit, said additional fuel supply means comprising an additional pulverized fuel supply conduit means arranged within said power fuel supply conduit and surrounding said air tube of said pilot burner for supplying fuel to the pilot flame through the power fuel supply conduit.

6. A burner system according to claim 5 wherein said additional pulverized fuel supply conduit means is arranged in said power fuel supply conduit at a point removed from the pilot flame and is substantially shorter in axial length than said power fuel supply conduit.

7. A burner system according to claim 5 wherein said additional fuel supply means comprises fuel supply conduits in said power fuel supply conduit circumferentially spaced about the periphery of said pilot burner air tube, the ends of said fuel supply conduits opening adjacent the end of said pilot burner having the pilot flame, the other ends of said fuel supply conduits being connected to a distributor means for distributing the additional pulverized fuel to the fuel supply channels.

8. A burner system according to claim 7 wherein said distribution means comprises a chamber connected to the other ends of said circumferentially spaced additional pulverized fuel supply conduits.

9. A burner system according to claim 5 further including means for stabilizing the pilot flame.

10. A burner system comprising:

a pilot burner burning pulverized pilot fuel to produce a pilot flame;

a pair of power burners on either side of said pilot burner, said power burners being ignited by said pilot burner and burning pulverized power fuel; and injection nozzles arranged around said pilot burner for supplying additional pulverized fuel to the pilot flame for improving ignition performance of said pilot burner in igniting said power burner.

11. A burner system according to claim 10 wherein said pilot burner has a coaxial configuration with a central pilot burner pulverized fuel duct and surrounding pilot burner air supply duct and wherein said injection nozzles comprise a plurality of additional fuel supply ducts forming an integral unit with the pilot burner air supply duct and being circumferentially spaced about the exterior of the pilot burner air supply duct.

* * * * *

UNITED STATES PATENT AND TRADEMARK OFFICE

CERTIFICATE OF CORRECTION

PATENT NO. : 4,474,120

DATED : October 2, 1984

INVENTOR(S) : FRITZ ADRIAN ET AL

It is certified that error appears in the above-identified patent and that said Letters Patent is hereby corrected as shown below:

| | |
|---|---|
| Add as an inventor | ---Franz Thelen, Muelheim--- |
| Abstract, Line 10, | After "respective" cancel "tube" and insert --- tubes ---; |
| Column 2, Line 31, | Cancel "diagrmmmatical" and insert --- diagrammatical ---; |
| Column 4, Line 31, | Cancel "tb" and insert --- to ---; |
| Column 5, Line 49, | Cancel "blame" and insert --- flame ---; |
| Column 6, Line 45, | after "said" insert --- additional ---. |

Signed and Sealed this

Sixteenth Day of April 1985

[SEAL]

*Attest:*

DONALD J. QUIGG

*Attesting Officer*

*Acting Commissioner of Patents and Trademarks*